US007179413B1

(12) United States Patent
Shin et al.

(10) Patent No.: US 7,179,413 B1
(45) **Date of Patent: *Feb. 20, 2007**

(54) FLASH-SPINNING PROCESS AND SOLUTION

(75) Inventors: Hyunkook Shin, Wilmington, DE (US); Roger K. Siemionko, Hockessin, DE (US); Carl G. Krespan, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 197 days.

This patent is subject to a terminal disclaimer.

(21) Appl. No.: 10/275,586

(22) PCT Filed: Aug. 18, 2000

(86) PCT No.: PCT/US00/22729

§ 371 (c)(1),
(2), (4) Date: Nov. 7, 2002

(87) PCT Pub. No.: WO01/14620

PCT Pub. Date: Mar. 1, 2001

Related U.S. Application Data

(60) Provisional application No. 60/150,002, filed on Aug. 20, 1999.

(51) Int. Cl.
*B29C 47/88* (2006.01)

(52) U.S. Cl. ..... 264/205; 252/8.84

(58) Field of Classification Search ..... 264/204, 264/211.14, 211, 331.11; 252/8.81, 8.84
See application file for complete search history.

(56) References Cited

U.S. PATENT DOCUMENTS 5,032,326 A * 7/1991 Shin ..... 264/13
5,147,586 A * 9/1992 Shin et al. ..... 264/13
5,672,307 A * 9/1997 Shin et al. ..... 264/205
5,874,036 A * 2/1999 Shin et al. ..... 264/205
5,985,196 A * 11/1999 Shin et al. ..... 264/205
6,004,672 A * 12/1999 Shin et al. ..... 428/364
6,153,134 A * 11/2000 Shin et al. ..... 264/50
6,162,379 A * 12/2000 Shin et al. ..... 264/41
6,270,709 B1 * 8/2001 Akki et al. ..... 264/205
6,291,566 B1 * 9/2001 Shin et al. ..... 524/390

(Continued)

*Primary Examiner*—Mark Eashoo

(57) ABSTRACT

A process for the preparation of plexifilamentary film-fibril strands of synthetic fiber-forming polymer comprises the steps of generating a spin fluid and flash-spinning the spin fluid to form plexifilamentary film-fibril strands of the synthetic fiber-forming polymer. The spin fluid consists essentially of (a) 5 to 30 wt. % of a synthetic fiber-forming polymer, (b) a primary spin agent selected from the group consisting of hydrocarbons with 4 to 7 carbon atoms, and chlorinated, brominated and fluorinated compounds, and (c) a co-spin agent co-spin agent selected from the group consisting essentially of fluorinated organic compounds containing 4 to 8 carbon atoms and a double bond, and having an atmospheric boiling point of less than 100° C. The co-spin agent is present in the spin fluid in an amount sufficient to raise the cloud point pressure of the spin fluid by at least 50 pounds per square inch (345 kPa). A spin fluid used in the process of the invention is also provided.

24 Claims, 9 Drawing Sheets

U.S. PATENT DOCUMENTS 6,303,682 B1 * 10/2001 Shin et al. ..... 524/462
6,319,970 B1 * 11/2001 Shin et al. ..... 524/366
6,352,773 B2 * 3/2002 Akki et al. ..... 428/364
6,455,619 B1 * 9/2002 McGinty et al. ..... 524/241
6,458,304 B1 * 10/2002 Shin et al. ..... 264/205
6,638,470 B2 * 10/2003 Schweiger ..... 264/469
6,692,826 B2 * 2/2004 Shin et al. ..... 428/364
6,793,840 B2 * 9/2004 Shin et al. ..... 252/8.81

* cited by examiner

FLASH-SPINNING PROCESS AND SOLUTION

This application claims benefit of priority from Provisional application No. 60/150,002, filed Aug. 20, 1999.

FIELD OF THE INVENTION

This invention relates to flash-spinning of polymeric plexifilamentary film-fibril strands. More particularly, this invention relates to a spin fluid that may be used with existing commercial flash-spinning equipment with minimum changes in the equipment.

BACKGROUND OF THE INVENTION

In the process for making flash-spun fibers, as disclosed in U.S. Pat. No. 3,081,519 to Blades et al. assigned to E.I. du Pont de Nemours and Company, Wilmington, Del. (hereafter DuPont), a solution of fiber-forming polymer in a liquid spin agent that is not a solvent for the polymer below the liquid's normal boiling point, is maintained at a temperature above the normal boiling point of the liquid and at autogenous pressure or greater, and is then spun into a zone of lower temperature and substantially lower pressure to generate plexifilamentary film-fibril strands. As disclosed in U.S. Pat. No. 3,227,794 to Anderson et al. (assigned to DuPont), the flash-spinning process requires a spin agent that: (1) is a non-solvent to the polymer below the spin agent's normal boiling point; (2) forms a solution with the polymer at high pressure; (3) forms a desired two-phase dispersion with the polymer when the solution pressure is reduced slightly in a letdown chamber; and (4) flash vaporizes when released from the letdown chamber into a zone of substantially lower pressure.

Commercial spunbonded products made from polyethylene plexifilamentary film-fibril strands have been produced by flash-spinning a spin fluid comprised of polyethylene in a trichlorofluoromethane spin agent. Unfortunately, trichlorofluoromethane is considered to be a stratospheric ozone depletion chemical, and therefore, there is a need for alternative spin agents for use in the flash-spinning process.

The Ozone Depletion Potential ("ODP") for a compound is a relative measure of the expected impact of the compound on the depletion of stratospheric ozone when the compound is released as a gas into the atmosphere as compared to the impact expected from the release of the same mass of trichlorofluoromethane gas. ODP values are used to compare the relative impacts of the release of different gases upon the Earth's ozone layer. The ODP values are generally calculated by methods like those described in Chapter 13 of "Scientific Assessment of Ozone Depletion: 1994," Report No. 37 of the World Meteorological Organization's Global Ozone Research and Monitoring Project.

The Global Warming Potential ("GWP") for a compound is a relative measure of the expected impact on the greenhouse warming of the Earth's atmosphere when the compound is released as a gas into the atmosphere as compared to the impact expected from the release of the same mass of carbon dioxide gas into the atmosphere. GWP is dependent on the degree of absorbance of longwave radiation (infared) by the compound, and the expected lifetime of the compound in the atmosphere. GWP values are generally calculated by methods like those described in Chapter 13 of "Scientific Assessment of Ozone Depletion: 1994," Report No. 37 of the World Meteorological Organization's Global Ozone Research and Monitoring Project.

In the flash-spinning process, the liquid spin agent is vaporized after passing through the spin orifice. The gaseous spin agent is conventionally collected, condensed, purified, and then recycled into the spin agent feed stream for the flash-spinning process. However, it is likely that a certain amount of the gaseous spin agent will escape to the atmosphere at some point. Accordingly, there is a need to find a spin agent that works well in the flash-spinning process that also has a very low ODP, a very low GWP, a boiling point of less than 100° C., and either no flash point or a flash point greater than 0° C.

U.S. Pat. No. 5,032,326 to Shin (assigned to DuPont) discloses an alternative flash-spinning spin agent, namely, dichloromethane (also referred to as methylene chloride) and a halocarbon co-spin agent having a boiling point between 0° C. and −50° C.

Published Japanese Application JP52633 10-A (published Oct. 12, 1993) discloses that three-dimensional flash-spun fibers made from polymer dissolved in mixtures of spin agents where the major component of the spin agent mixture is selected from the group consisting of dichloromethane, dichloroethylene, and bromochloromethane, and the minor component of the spin agent mixture is selected from the group consisting of dodecafluoropentane, decafluoropentane, and tetradecafluorohexane.

U.S. Pat. No. 5,672,307 (assigned to DuPont) discloses a process for flash-spinning plexifilamentary film-fibril strands from polyolefin polymer dissolved in mixtures of spin agents where the major component of the spin agent mixture is selected from the group consisting of dichloromethane and dichloroethylene, and the minor component of the spin agent mixture is selected from the group consisting of hydrofluoroethers and cyclic perfluorinated hydrocarbons, wherein the minor component of the spin agent has 3 to 7 carbon atoms and an atmospheric boiling point between 15° C. and 100° C.

U.S. Pat. No. 5,874,036 (assigned to DuPont) discloses a process for flash-spinning plexifilamentary film-fibril strands from polyolefin polymer dissolved in mixtures of spin agents where the major component of the spin agent mixture is selected from the group consisting of dichloromethane and dichloroethylene, and the minor component of the spin agent mixture is a cyclic partially fluorinated hydrocarbon having 4 to 7 carbon atoms and an atmospheric boiling point between 15° C. and 100° C.

The co-spin agents disclosed in the four patent publications discussed above do not exhibit the desired combination of having a very low ODP, a very low GWP, a boiling point of less than 100° C., and either no flash point or a flash point greater than 0° C. Accordingly, there is a need for an alternative co-spin agent for use in the flash-spinning process, which co-spin agent has a very low ODP, a very low GWP, a boiling point of less than 100° C., and either no flash point or a flash point greater than 0° C.

BRIEF SUMMARY OF THE INVENTION

The present invention is a process for the preparation of plexifilamentary film-fibril strands of synthetic fiber-forming polymer. The process comprises the steps of generating a spin fluid and flash-spinning the spin fluid at a pressure that is greater than the autogenous pressure of the spin fluid into a region of lower pressure to form plexifilamentary film-fibril strands of the synthetic fiber-forming polymer. The spin fluid consists essentially of (a) 5 to 30 wt. % of a synthetic fiber-forming polymer, (b) a primary spin agent selected from the group consisting of hydrocarbons with 4 to 7 carbon atoms, and chlorinated, brominated and fluorinated compounds, and (c) a co-spin agent selected from the group consisting essentially of fluorinated organic compounds containing 4 to 8 carbon atoms and a double bond and having an atmospheric boiling point of less than 10° C. The co-spin agent is present in the spin fluid in an amount sufficient to raise the cloud point pressure of the spin fluid by at least 50 pounds per square inch (345 kPa).

Preferably the co-spin agent is selected from the group consisting of perfluorocarbons, hydrofluorocarbons, hydrochlorofluorocarbons, hydrofluoroethers, hydrofluoroesters, hydrofluoroalcohols, hydrofluoroketones, and mixtures thereof. More preferably, the co-spin agent is an unsaturated hydrofluorocarbon, and most preferably the co-spin agent is 3,3,4,4,5,5,6,6,6-nonafluoro-1-hexene.

The preferred primary spin agent for use in the process of the invention is selected from the group of dichloroethylene, dichloroethane, dichloromethane, 1,1,2-trichloro-2,2-difluoroethane, bromochloromethane, perfluorodecalin, cyclopentane, n-pentane, cyclohexane, n-hexane, n-heptane, and mixtures thereof.

The preferred fiber-forming polymer for use in the process of the invention is selected from the group consisting of polyolefins, partially fluorinated hydrocarbons, and fully fluorinated hydrocarbons. More preferably, the polymer is a polyolefin. Most preferably, the spin fluid contains 8 to 18 wt. % polyethylene polymer.

According to the preferred embodiment of the invention, the co-spin agent comprises 10 to 80 wt. % of total weight of the primary and co-spin agents. Preferably, the co-spin agent has no flash point or a flash point greater than 0° C., an Ozone Depletion Potential of less than 0.1, and a Global Warming Potential of less than 200. More preferably, the co-spin agent has an Ozone Depletion Potential of less than 0.05 and a Global Warming Potential of less than 100. Most preferably, the co-spin agent has a Global Warming Potential of less than 10. It is further preferred that the co-spin agent be present in the spin fluid in an amount sufficient to raise the cloud point pressure of the spin fluid by at least 200 pounds per square inch (1379 kPa) and that the co-spin agent have a boiling point greater than 0° C. The co-spin agent may include at least one hydrogen atom.

The present invention is also directed to a spin fluid consisting essentially of (a) 5 to 30 wt. % of a synthetic fiber-forming polymer, (b) a primary spin agent selected from the group consisting of hydrocarbons with 4 to 7 carbon atoms, and chlorinated, brominated and fluorinated compounds, and (c) a co-spin agent selected from the group consisting essentially of fluorinated organic compounds containing 4 to 8 carbon atoms and a double bond and having an atmospheric boiling point of less than 100° C. The co-spin agent is present in the spin fluid in an amount sufficient to raise the cloud point pressure of the spin fluid by at least 50 pounds per square inch (345 kPa). Preferably the co-spin agent is selected from the group consisting of perfluorocarbons, hydrofluorocarbons, hydrochlorofluorocarbons, hydrofluoroethers, hydrofluoroesters, hydrofluoroalcohols, hydrofluoroketones, and mixtures thereof. More preferably, the co-spin agent is an unsaturated hydrofluorocarbon, and most preferably the co-spin agent is 3,3,4,4,5,5,6,6,6-nonafluoro-1-hexene. The preferred primary spin agent of the spin fluid is selected from the group of dichloroethylene, dichloroethane, dichloromethane, 1,1,2-trichloro-2,2-difluoroethane, bromochloromethane, perfluorodecalin, cyclopentane, n-pentane, cyclohexane, n-hexane, n-heptane, and mixtures thereof. The preferred synthetic fiber-forming polymer of the spin fluid is selected from the group consisting of polyolefins, partially fluorinated hydrocarbons, and fully fluorinated hydrocarbons.

BRIEF DESCRIPTION OF THE DRAWING(S)

The accompanying drawings, which are incorporated in and constitute a part of this specification, illustrate an apparatus for practicing the process of the invention, and the cloud point pressures for various spin fluids over a range of temperatures.

DEFINITIONS

Figure 1:
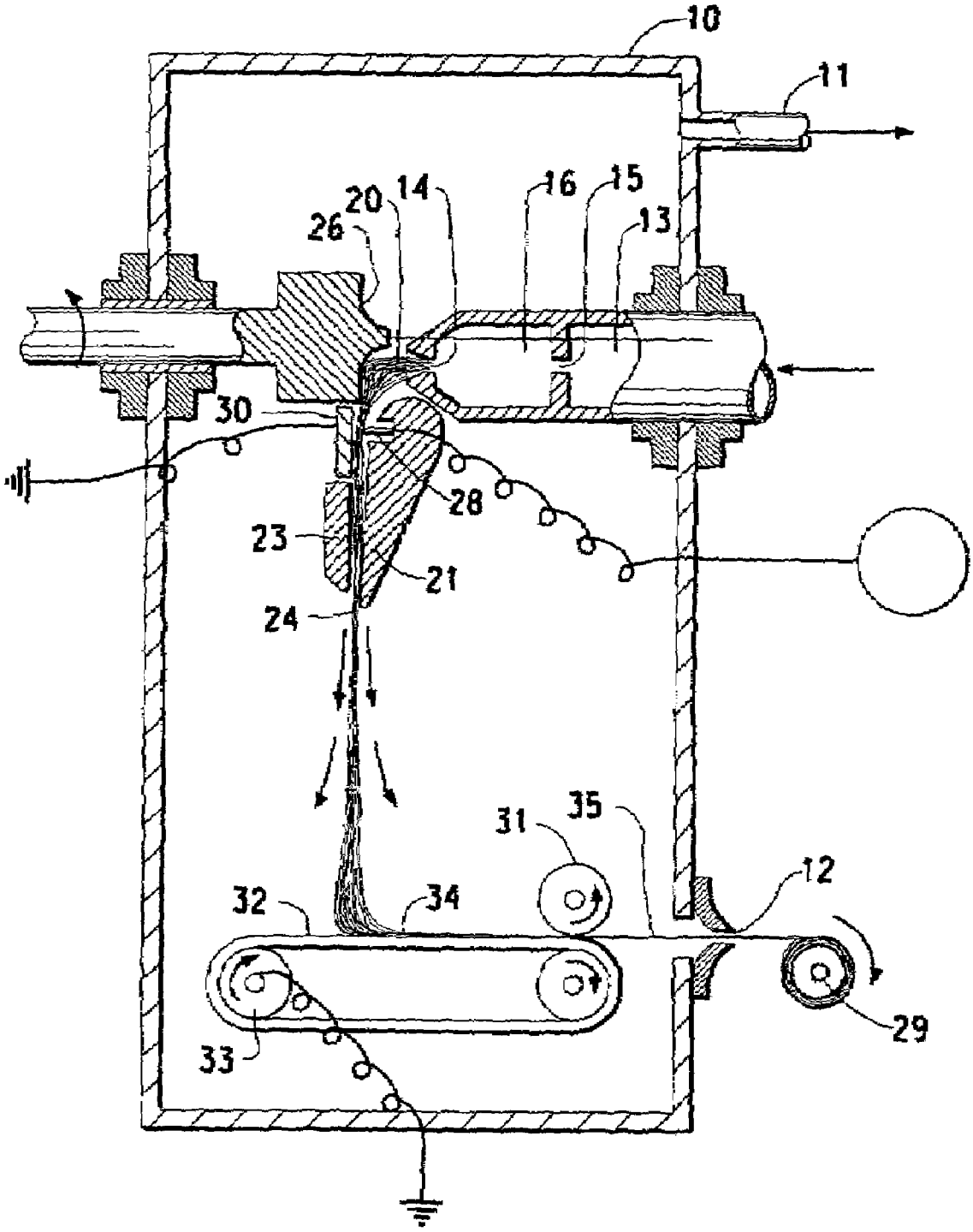
FIG. 1 (PRIOR ART)
FIG. 1 is a cross-sectional schematic representation of a spinning apparatus according to the prior art.

The term "synthetic fiber-forming polymer" as used herein is intended to encompass the classes of polymers known to be flash-spinnable in the flash-spinning art.

The term "polyethylene" as used herein is intended to encompass not only homopolymers of ethylene, but also copolymers wherein at least 85% of the recurring units are ethylene units such as copolymers of ethylene and alpha-olephins. Preferred polyethylenes include linear low density polyethylene and linear high density polyethylene. A preferred linear high density polyethylene has an upper limit melting range of about 130° to 140° C., a density in the range of 0.94 to 0.98 gram per cubic centimeter, and a melt index (as defined by ASTM D-1238-57T Condition E) of between 0.1 and 100, and preferably less than 4.

The term "polypropylene" as used herein is intended to embrace not only homopolymers of propylene but also copolymers where at least 85% of the recurring units are propylene units. Preferred polypropylene polymers include isotactic polypropylene and syndiotactic polypropylene.

The term "polyolefin" as used herein, is intended to mean any of a series of largely saturated polymeric hydrocarbons composed only of carbon and hydrogen. Typical polyolefins include, but are not limited to, polyethylene, polypropylene, polymethylpentene and various combinations of the monomers ethylene, propylene, and methylpentene.

The term "plexifilamentary" as used herein, means a three-dimensional integral network of a multitude of thin, ribbon-like, film-fibril elements of random length and with a mean film thickness of less than about 4 micrometers and a median fibril width of less than about 25 micrometers. In plexifilamentary structures, the film-fibril elements are generally coextensively aligned with the longitudinal axis of the structure and they intermittently unite and separate at irregular intervals in various places throughout the length, width and thickness of the structure to form a continuous three-dimensional network.

The term "cloud-point pressure" as used herein, means the pressure at which a single phase liquid polymer solution starts to phase separate into a polymer-rich/spin agent-rich two-phase liquid/liquid dispersion.

TEST METHODS

The denier of the strand was determined from the weight of a 15 cm sample length of strand under a predetermined load.

Tenacity and elongation of the flash-spun strand were determined with an Instron tensile-testing machine. The strands were conditioned and tested at 70° F. (21° C.) and 65% relative humidity. The strands were then twisted to 10 turns per inch and mounted in the jaws of the Instron Tester. A two-inch gauge length was used with an initial elongation rate of 4 inches per minute (10.2 cm/min). The tenacity at break is recorded in grams per denier (gpd). The elongation at break is recorded as a percentage of the two-inch gauge length of the sample. Modulus corresponds to the slope of the stress/strain curve and is expressed in units of gpd.

The apparatus and procedure for determining the cloud point pressures of a polymer/spin agent combination are those described in U.S. Pat. No. 5,147,586 to Shin et al. The flash point for a compound is determined in accordance with ASTM Method D-56-79.

DETAILED DESCRIPTION OF THE INVENTION

Reference will now be made in detail to the presently preferred embodiments of the invention, examples of which are illustrated below. The present invention relates to flash-spinning of spin fluids comprising a fiber-forming polymer and a novel spin agent to form polymeric plexifilamentary film-fibril strands. The general flash-spinning apparatus chosen for illustration of the present invention is similar to that disclosed in U.S. Pat. No. 3,860,369 to Brethauer et al., which is hereby incorporated by reference. A system and process for flash-spinning a fiber-forming polymer is fully described in U.S. Pat. No. 3,860,369, and is shown in FIG. 1. The flash-spinning process is normally conducted in a chamber 10, sometimes referred to as a spin cell, which has a spin agent removal port 11 and an opening 12 through which non-woven sheet material produced in the process is removed. A spin fluid, comprising a mixture of polymer and spin agent, is provided through a pressurized supply conduit 13 to a spinning orifice 14. The spin fluid passes from supply conduit 13 to a chamber 16 through a chamber opening 15. In certain spinning applications, chamber 16 may act as a pressure letdown chamber wherein a reduction in pressure causes phase separation of the spin fluid, as is disclosed in U.S. Pat. No. 3,227,794 to Anderson et al. A pressure sensor 22 may be provided for monitoring the pressure in the chamber 16.

The spin fluid in chamber 16 next passes through spin orifice 14. It is believed that passage of the pressurized polymer and spin agent from the chamber 16 into the spin orifice generates an extensional flow near the approach of the orifice that helps to orient the polymer. When polymer and spin agent discharge from the orifice, the spin agent rapidly expands as a gas and leaves behind fibrillated plexifilamentary film-fibrils. The gas exits the chamber 10 through the port 11. Preferably, the gaseous spin agent is condensed for reuse in the spin fluid.

The polymer strand 20 discharged from the spin orifice 14 is conventionally directed against a rotating deflector baffle 26. The rotating baffle 26 spreads the strand 20 into a more planar web structure 24 that the baffle alternately directs to the left and right. As the spread web descends from the baffle, the web is electrostatically charged so as to hold the web in a spread open configuration until the web 24 reaches a moving belt 32. The web 24 deposits on the belt 32 to form a batt 34. The belt is grounded to help insure proper pinning of the charged web 24 on the belt. The fibrous batt 34 may be passed under a roller 31 that compresses the batt into a sheet 35 formed with plexifilamentary film-fibril networks oriented in an overlapping multi-directional configuration. The sheet 35 exits the spin chamber 10 through the outlet 12 before being collected on a sheet collection roll 29.

According to the present invention, the spin agent comprises a mixture of a primary spin agent and a co-spin agent. The primary spin agent is selected from the group consisting of hydrocarbons having four to seven carbon atoms and other chlorinated, brominated of fluorinated compounds having an ODP less than 0.1 and a GWP less than 200. The co-spin agent comprises a partially or fully fluorinated organic compound containing a double bond. As used herein, the term "primary spin agent" refers to the spin agent component having the greatest solubility in the polymer. The spin agent mixtures are especially useful when the primary spin agent has such a high solubility in the polymer that the cloud-point pressure of a solution of 5–30 wt % polymer (based on the total weight of the spin fluid) in the primary spin agent is so close to the bubble point that it is not possible to operate the flash spinning process efficiently. For example, the mixed spin agents are particularly useful when a solution of the polymer in the primary spin agent has a cloud point pressure less than about 2000 lb/in$^2$ (psi)(13790 kPa), and more preferably less than about 1000 psi (6895 kPa), at the flash spinning temperature, which is generally between $T_c$–40° C. and $T_c$+40° C. ($T_c$=spin agent critical temperature). The co-spin agent is added to the primary spin agent in a sufficient amount to raise the cloud-point pressure of the polymer solution by at least 50 psi (345 kPa). Preferably, the cloud-point pressure of the polymer solution is raised at least 200 psi (1379 kPa) by the addition of the co-spin agent.

Examples of suitable primary spin agents include chlorinated solvents such as trans-1,2-dichloroethylene, cis-1,2-dichloroethylene, 1,1 dichloroethane, dichloromethane, and 1,1,2-trichloro-2,2-difluoroethane (HCFC-122), brominated solvents such as bromochloromethane and propyl bromide, fluorinated solvents such as perfluorodecalin, and hydrocarbons such as cyclopentane, cyclohexane, n-hexane, and n-heptane. Under conditions generally used in flash-spinning processes, some of the trans-1,2-dichloroethylene isomerizes to form cis-1,2-dichloroethylene. Therefore, whenever trans-1,2-dichloroethylene is used herein, it is understood to include mixtures of trans- and cis-1,2-dichloroethylene. The preferred primary spin agents for flash spinning polyolefins are trans-1,2-dichloroethylene and dichloromethane. HCFC-122 is less preferred due to toxicity issues. The brominated solvents are less stable at high temperatures used in flash spinning and therefore are also less preferred.

Preferably, the compounds used as primary spin agents in the process of the invention exhibit a low ozone depletion potential of less than 0.1, and more preferably of less than 0.05. The primary spin agents should also exhibit a low global warming potential of less than 200, and preferably less than 100, and more preferably less than 10. It is further preferred that the primary spin agents of the invention exhibit low flammability or combustibility (either no flash point or a flash point greater than 0° C.). In addition, the compounds used as primary spin agents in the flash-spinning process of the invention preferably have a dielectric strength of at least 40 kV/cm, and more preferably of at least 60 kV/cm.

According to the preferred embodiment of the invention, the co-spin agent should be capable of raising the cloud point pressure of the spin fluid by at least 50 psi (345 kPa) at spin temperatures in the general range of 150° C. to 360° C., depending on the polymer and spin agent(s) being spun. Preferably, the co-spin agent is added to the spin fluid in an amount such that the co-spin agent comprises from 10% to 80% by weight of the spin agent in the spin fluid. The co-spin agent should have an atmospheric boiling point of less than about 100° C. More preferably, the co-spin agent has an atmospheric boiling of between 0° C. and 100° C., and most preferably of between about 20° C. and about 70° C. The boiling point of the co-spin agent should be less than 100° C. because the co-spin agent must readily vaporize during flash-spinning when the spin fluid is discharged through a spin orifice into a zone maintained at approximately atmospheric pressure. The co-spin agent preferably has an atmospheric boiling point above 0° C. and more preferably above 20° C. because in the flash-spinning process, the spin agent is condensed for reuse after it flash vaporizes. If the boiling point of the co-spin agent is below 0° C., it is difficult and expensive to condense the co-spin agent for reuse in the flash-spinning process.

The compounds used as co-spin agents in the process of the invention have an improved combination of properties making them desirable for use in flash-spinning. The compounds exhibit a low ozone depletion potential of less than 0.1, and more preferably of less than 0.05. The co-spin agents also exhibit a low global warming potential of less than 200, and preferably less than 100, and more preferably less than 10. The co-spin agents of the invention also exhibit low flammability or combustibility (either no flash point or a flash point greater than 0° C.). The compounds used as co-spin agents in the flash-spinning process of the invention preferably have a dielectric strength of at least 40 kV/cm, and more preferably at least 60 kV/cm.

The co-spin agents used in the process of the invention are partially or fully fluorinated organic compounds containing a double bond. Without wishing to be bound by theory, it is believed that the presence of the fluorine atoms in the compound reduces the flammability of the co-spin agent while the presence of the double bond in the compound keeps the global warming potential of the compound low. Preferred co-spin agents include unsaturated perfluorocarbons, unsaturated hydrofluorocarbons, and unsaturated hydrofluoroethers.

Suitable unsaturated perfluorocarbon co-spin agents include perfluoro-2-pentene and perfluorocyclopentene. Other acyclic perfluoroolefins having from 4 to 8 carbon atoms and from 8 to 16 fluorine atoms, respectively, should have low flammability, a zero ODP, a low GWP, and a boiling point within the range required for a satisfactory flash-spinning co-spin agent. Examples of such compounds include perfluoro-1-heptene, $CF_3CF{=}CFCF_3$, $CF_3CF{=}CFCF_2CF_3$, $CF_3CF_2CF{=}CFCF_2CF_2CF_3$, $CF_3CF{=}CFCF_2CF_2CF_2CF_3$, $(CF_3)_2C{=}CFCF_2CF_3$, $(CF_3)_2CFCF{=}CFCF_3$. Other cyclic perfluoroolefins having 4 to 8 carbon atoms should have low flammability, a zero ODP, a low GWP, and a boiling point within the range required for a satisfactory co-spin agent. Examples of such cyclic compounds include perfluorocyclobutene, perfluorocyclohexene, 1-perfluoroethyl-perfluorocyclobutene, 1-perfluoromethyl-perfluorocyclopentene, and 1-perfluoroethyl-perfluorocyclobutene.

A preferred co-spin agent useful in the present invention is 3,3,4,4,5,5,6,6,6-nonafluoro-1-hexene (also known as perfluorobutyl ethylene) (commercially available from DuPont under the tradename Zonyl® PFBE), which has a GWP of less than about 10, an ozone depletion potential of zero and no flash point. There are other acyclic unsaturated hydrofluorocarbons with limited hydrogen atoms that should have low flammability, a zero ODP, a low GWP, and a boiling point within the range required for a satisfactory flash-spinning co-spin agent. Examples of such compounds include $CF_3(CF_2)_nCH{=}CH_2$, where n equals 1, 2, 4, 5, or 6; $CF_3CH{=}CHCF_3$; $CF_3CF_2CH{=}CHCF_2CF_3$; $CF_3CH{=}CHCF_2CF_3$; $(CF_3)_2C{=}CH_2$; $CF_3CH{=}CFCF_2CF_3$; $CF_3CF{=}CHCF_2CF_3$; 6H-perfluoro-1-hexene; 3,4,4,5,5,5-hexafluoro-3-(trifluoromethyl)-1-pentene; and 4,5,5,6,6,6-hexafluoro-4-(trifluoromethyl)-2-hexene.

Cyclic hydrofluoroolefins having 4 to 6 carbon atoms should have low flammability, a zero ODP, a low GWP, and a boiling point within the range required for a satisfactory co-spin agent in the process and spin fluid of the current invention. Examples of such cyclic compounds include 1H, 2H-perfluorocyclobutene, 1H, 2H-perfluorocyclopentene, 1H-perfluorocyclobutene, and 1H-perfluorocyclopentene.

Certain hydrochlorofluorocarbons with low (but not zero) ODPs and low GWPs that are expected to make satisfactory co-spin agents for the process and spin fluid of the present invention include 4-chloro-1,1,2-trifluoro-1-butene, and 1-chloro-2,3,3-trifluorocyclobutene.

Unsaturated hydrofluoroether co-spin agents that should have low flammability, a zero ODP, a low GWP, and a boiling point within the range required for a satisfactory flash-spinning co-spin agent, include the following: 1,2-dimethoxy-3,3,4,4,5,5-hexafluorocyclopentene, 1-ethoxy-2,3,3,4,4,5,5-heptafluorocyclopentene, 1-methoxy(perfluoro-2-methyl-1-propene), $CF_3CF{=}CFOCH_3$, $CF_3CF{=}CFOCH_2CH_3$, $(CF_3)_2C{=}CFOCH_3$, $CF_3CF{=}C(CF_3)OCH_2CH_3$, $CF_3C(OCH_2CH_3){=}CFCF_2CF_3$.

Other unsaturated compounds that are expected to make satisfactory co-spin agents in the process and spin fluid of the invention include hydrofluoroesters, hydrofluoroalcohols, and hydrofluoroketones with a double bond. The preferred hydrofluoroesters include $CF_2{=}CFCO_2CH_3$, $CF_3CF_2CO_2CH{=}CH_2$, $CF_3CF{=}CFCO_2CH_3$, and $CF_3CF_2CF_2CO_2CH{=}CH_2$. The preferred hydrofluoroalcohols include $CF_2{=}CFCH_2OH$, $CF_3CF{=}CFCH_2OH$, $CF_3CF{=}C(CH_3)OH$. A preferred hydrofluoroketone is $CF_3CF{=}CFCOCH_3$.

Fiber forming synthetic polymers that can be flash-spun from the spin agents described above include polyolefins such as polyethylene, polypropylene, poly(4-methyl pentene-1), and blends thereof. Such polyolefins can be flash-spun from a spin fluid in which the polyolefin is dissolved in a spin agent comprised of a primary spin agent such as dichloromethane, dichloroethylene, or HCFC-122, and a co-spin agent that is one of the partially or fully fluorinated organic compounds containing a double bond that are described above. Preferred spin agents for polyolefins include mixtures of 1,2-dichloroethylene and 3,3,4,4,5,5,6,6,6-nonafluoro-1-hexene, dichloromethane and 3,3,4,4,5,5,6,6,6-nonafluoro-1-hexene, and cyclopentane and 3,3,4,4,5,5,6,6,6-nonafluoro-1-hexene.

Other fiber forming synthetic polymer that can be flash-spun from the spin agents described above include partially fluorinated hydrocarbon polymers in which between 10% and 70% of the total number of hydrogen atoms in the hydrocarbon polymer are replaced by fluorine atoms. Preferably, the partially fluorinated hydrocarbon polymers are comprised of at least 80% by weight of polymerized monomer units selected from ethylene, tetrafluoroethylene, chlorotrifluoroethylene, vinylidene fluoride and vinyl fluoride. A particularly preferred partially fluorinated hydrocarbon polymer is comprised of 40% to 70% by weight of polymerized monomer units of tetrafluoroethylene and 10% to 60% by weight of polymerized monomer units of ethylene, such as a copolymer comprised of substantially alternating units of ethylene and tetrafluoroethylene with the chemical structure $—(CH_2CH_2)—(CF_2CF_2)—$. Such ethylene/tetrafluoroethylene copolymers are disclosed, for example, in U.S. Pat. No. 3,624,250 to Carlson (assigned to DuPont), U.S. Pat. No. 3,870,689 to Modena et al., and U.S. Pat. No. 4,677,175 to Ihara et al. Ethylene/tetrafluoroethylene copolymer resin is commercially available from DuPont under the tradename TEFZEL®, which is a registered trademark of DuPont. TEFZEL® fluoropolymer resins have melting points between 235° and 280° C.

Another partially fluorinated hydrocarbon polymer that may be flash-spun from the spin agents described above is a polymer comprised of greater than 85% to 70% by weight of polymerized monomer units of vinylidene fluoride. Polyvinylidene fluoride polymer resins with the chemical structure $—(CH_2CF_2)—$ are commercially available from Elf Atochem under the tradename KYNAR®, which is a registered trademark of Elf Atochem. KYNAR® fluoropolymer resins have a melting point of about 170° C. Another partially fluorinated hydrocarbon polymer that may be flash-spun from the spin agents described above is a copolymer of alternating monomer units of ethylene and chlorotrifluoroethylene, such as HALAR® fluoropolymer resin obtained from Ausimont. Another partially fluorinated polymer that may be flash-spun from the spin agents described above is polyvinyl fluoride.

FIGS. 2–9 are plots of cloud point pressure vs. temperature for a number of polymers in various mixtures of a strong primary spin agent (dichloroethylene, dichloromethane, or cyclopentane) and 3,3,4,4,5,5,6,6,6-nonafluoro-1-hexene co-spin agent. Where spin agent ratios are expressed herein, the first number refers to weight percent of the primary spin agent in the spin agent mixture, and the second number refers to the weight percent of the co-spin agent in the spin agent mixture.

Figure 2:
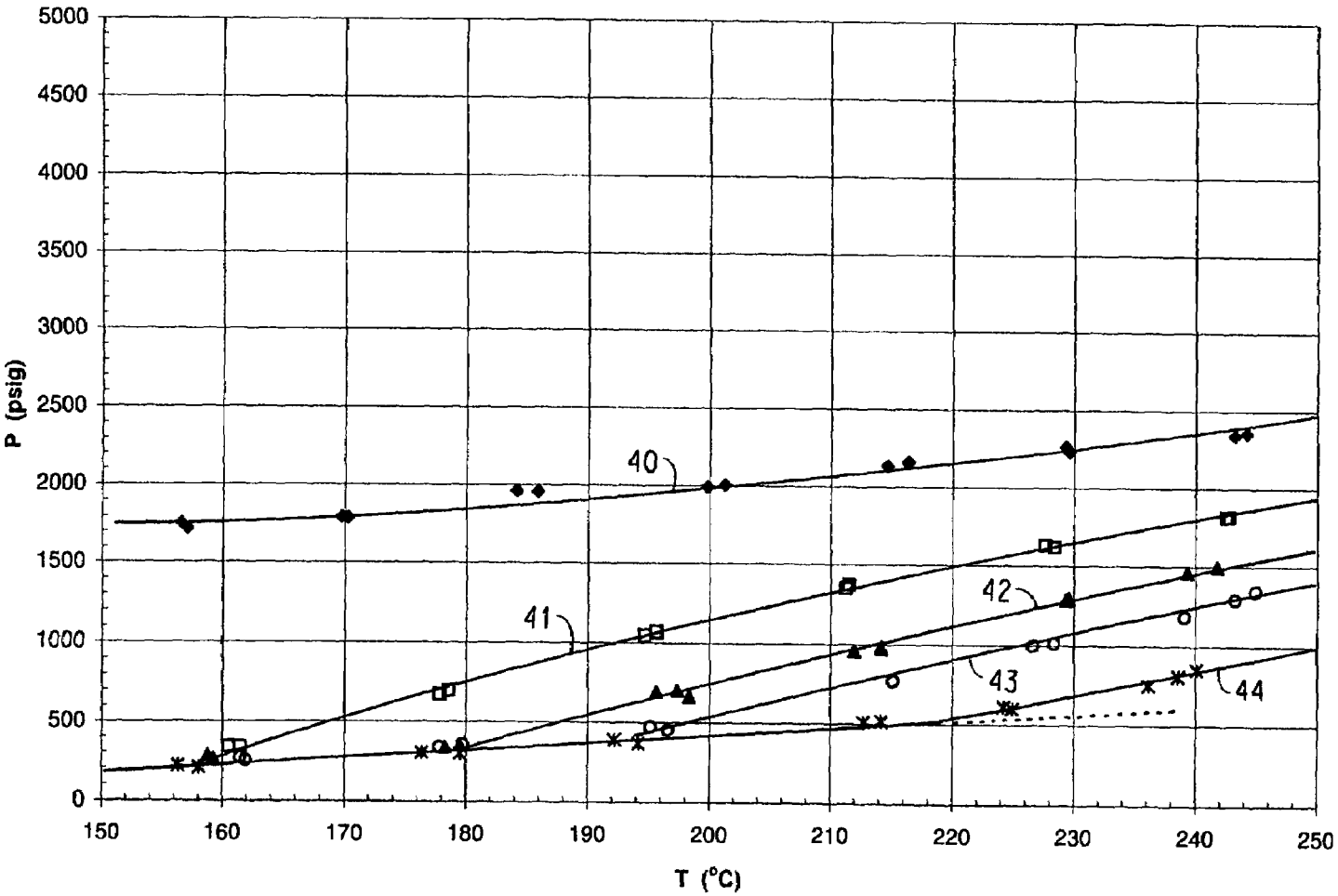
FIG. 2 is a plot of the cloud point data for a 10% by weight polypropylene solution in a spin agent comprised of 100% trans-1,2-dichloroethylene and four mixtures of trans-1,2-dichloroethylene and 3,3,4,4,5,5,6,6,6-nonafluoro-1-hexene (also referred to as perfluorobutyl ethylene).

FIG. 2 is a plot of the cloud point data for a solution of a 10% by weight solution of polypropylene in a spin agent comprised of either a mixture of trans-1,2-dichloroethylene and 3,3,4,4,5,5,6,6,6-nonafluoro-1-hexene at four different spin agent weight ratios (50/50, curve 40; 60/40, curve 41; 70/30, curve 42; and 80/20, curve 43) or 100% trans-1,2-dichloroethylene (curve 44).

Figure 3:
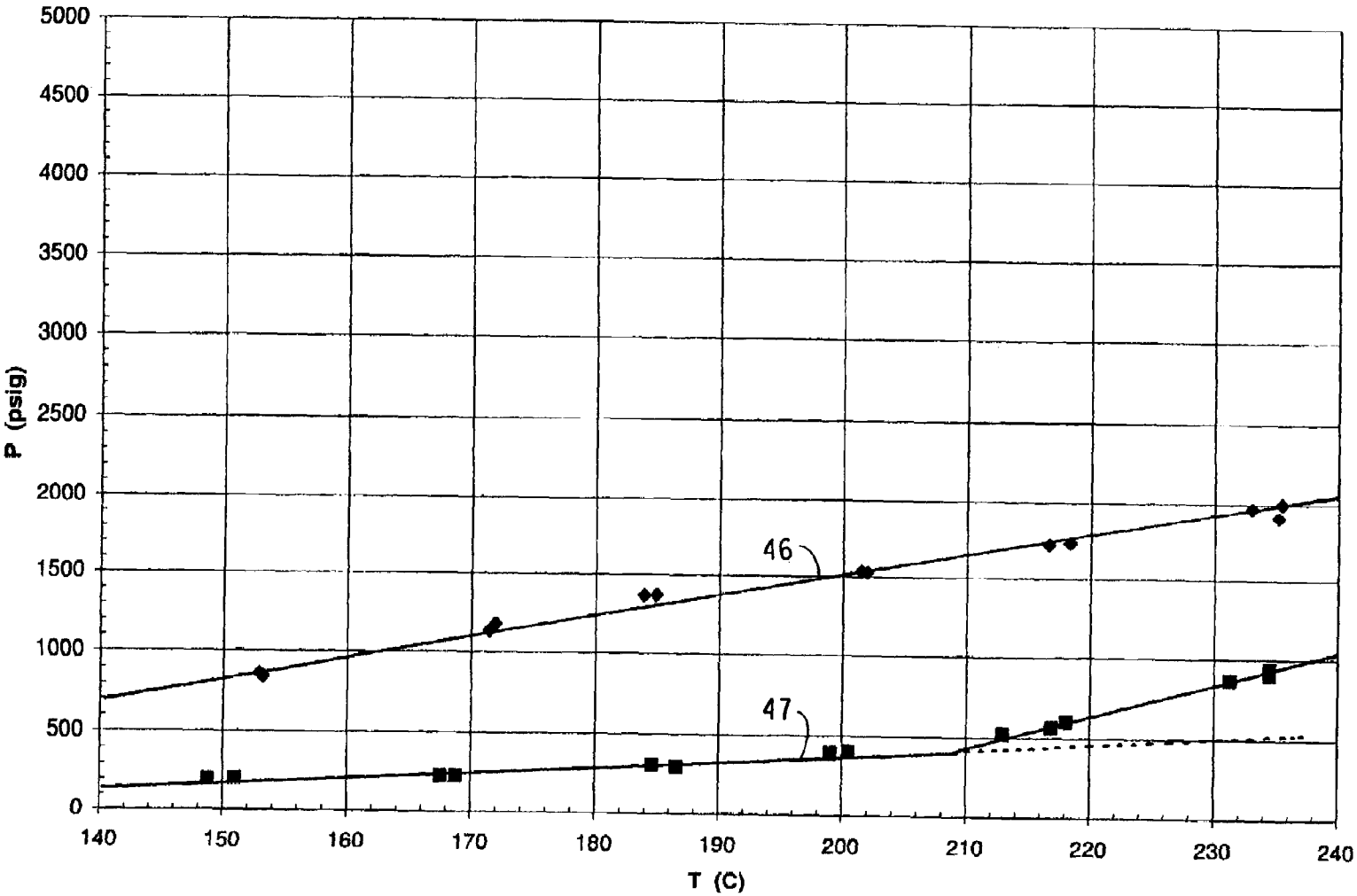
FIG. 3 is a plot of the cloud point data for an 18% by weight high density polyethylene solution in a spin agent comprised of 100% cyclopentane and a mixture of cyclopentane and 3,3,4,4,5,5,6,6,6-nonafluoro-1-hexene.

FIG. 3 is a plot of the cloud point data for an 18% by weight high density polyethylene solution in a spin agent comprised of 65% cyclopentane and 35% 3,3,4,4,5,5,6,6,6-nonafluoro-1-hexene (curve 46) or 100% cyclopentane (curve 47).

Figure 4:
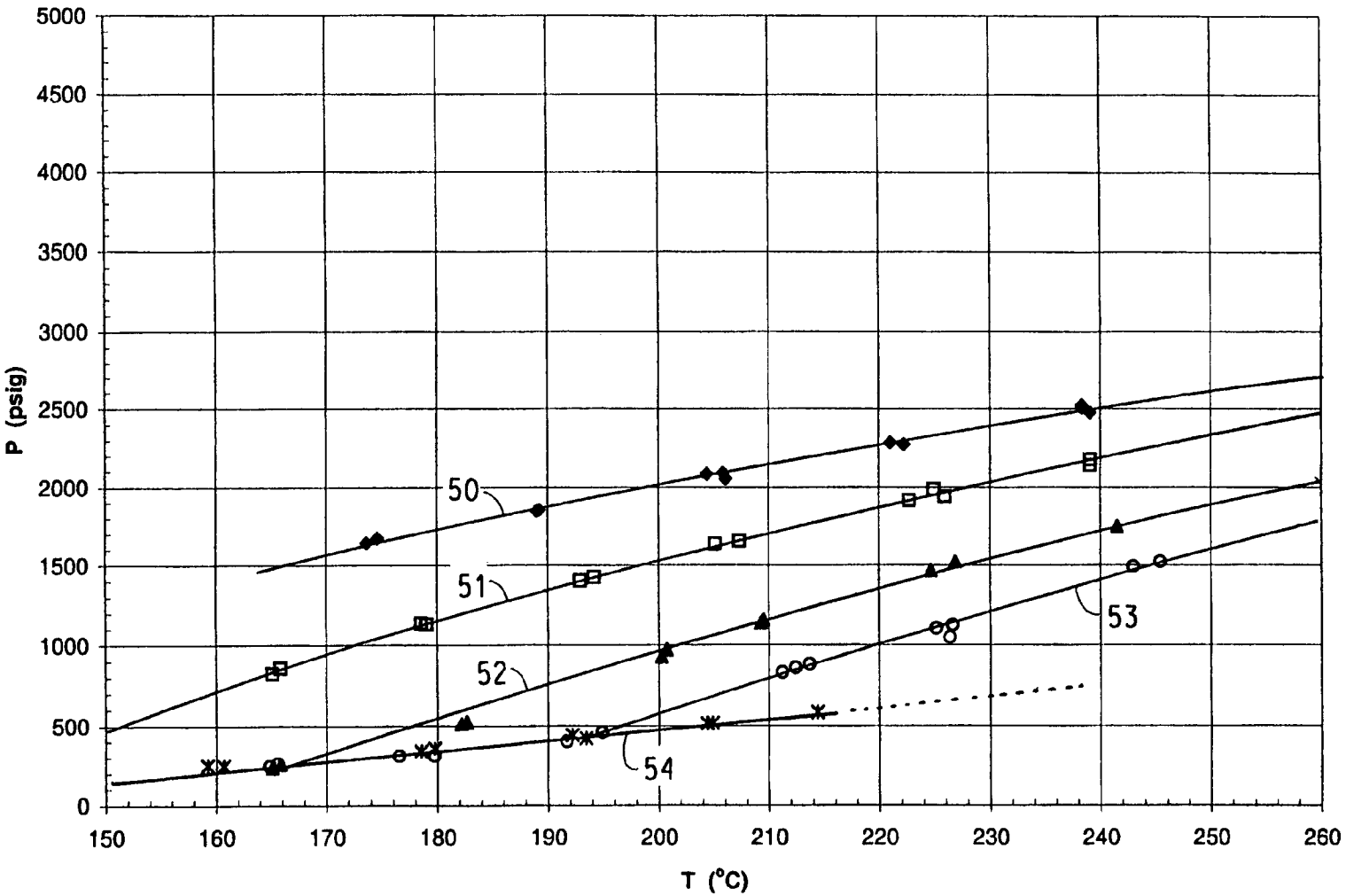
FIG. 4 is a plot of the cloud point data for a 20% by weight HALAR® fluoropolymer (copolymer of alternating monomer units of ethylene and chlorotrifluoroethylene) solution in a spin agent comprised of 100% trans-1,2-dichloroethylene and four mixtures of trans-1,2-dichloroethylene and 3,3,4,4,5,5,6,6,6-nonafluoro-1-hexene.

FIG. 4 is a plot of the cloud point data for a 20% by weight HALAR® fluoropolymer (copolymer of alternating monomer units of ethylene and chlorotrifluoroethylene) solution in a spin agent comprised of a mixture of trans-1,2-dichloroethylene and 3,3,4,4,5,5,6,6,6-nonafluoro-1-hexene at four different spin agent weight ratios (50/50, curve 50; 60/40, curve 51; 70/30, curve 52; and 80/20, curve 53) or 100% trans-1,2-dichloroethylene (curve 54).

Figure 5:
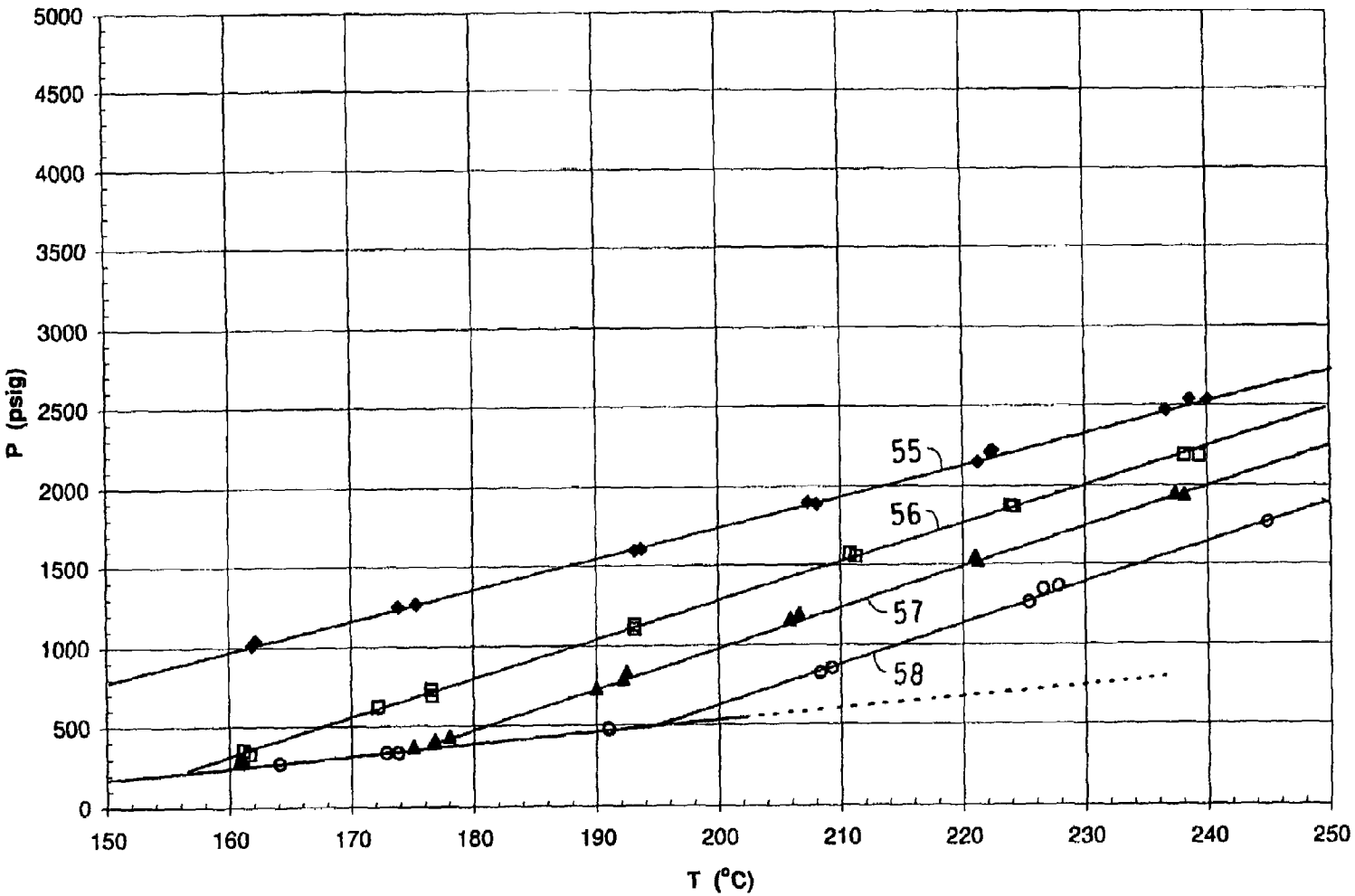
FIG. 5 is a plot of the cloud point data for a 12% by weight KYNAR® polyvinylidene fluoride polymer solution in a spin agent comprised of 100% dichloromethane and two mixtures of dichloromethane and 3,3,4,4,5,5,6,6,6-nonafluoro-1-hexene.

FIG. 5 is a plot of the cloud point data for a 12% by weight KYNAR® polyvinylidene fluoride polymer solution in a spin agent comprised of a mixture of dichloromethane and 3,3,4,4,5,5,6,6,6-nonafluoro-1-hexene at three different spin agent weight ratios (80/20, curve 55; 85/15, curve 56; and 90/10, curve 57) or 100% dichloromethane (curve 58).

Figure 6:
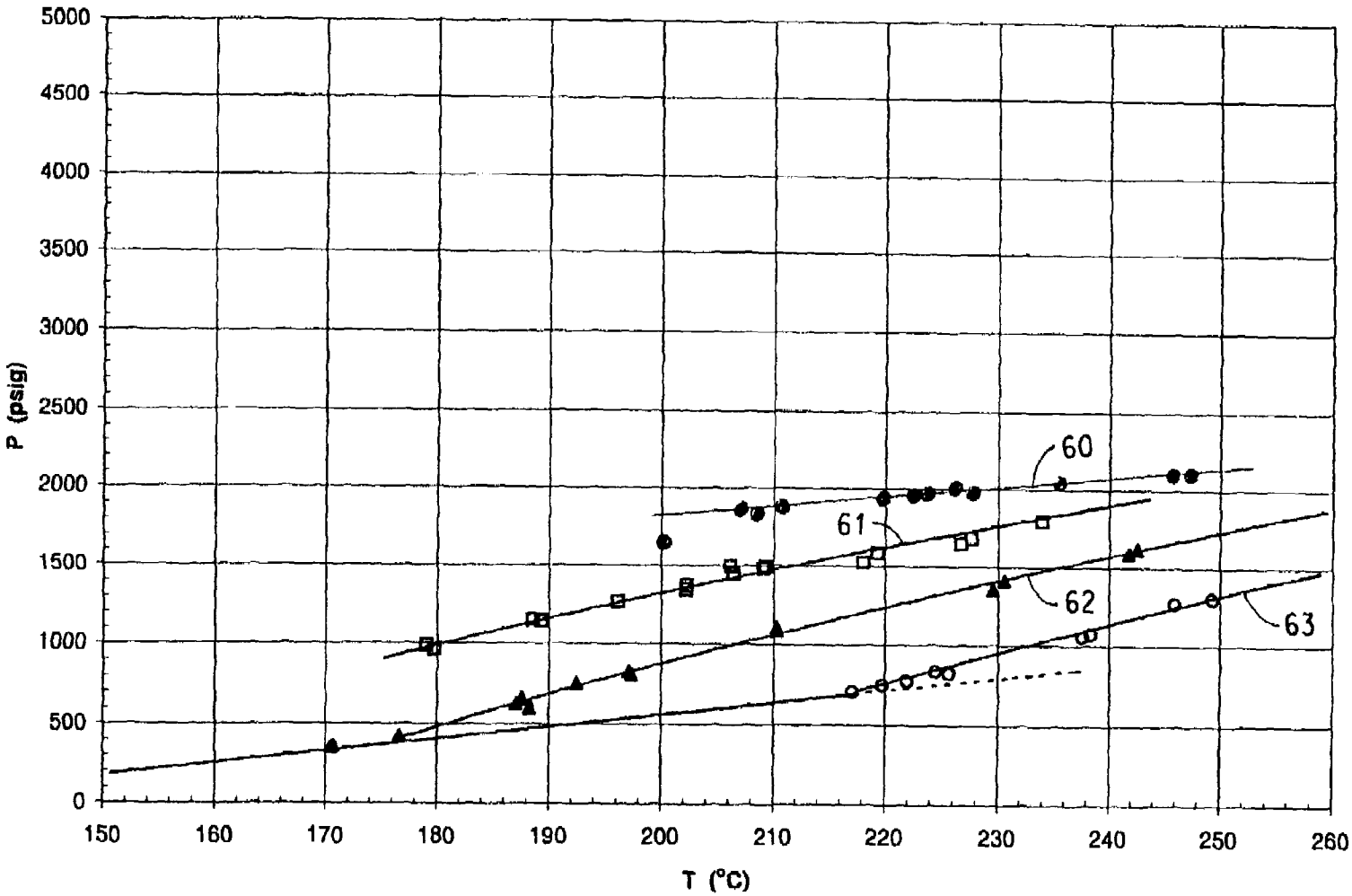
FIG. 6 is a plot of the cloud point data for 20% by weight TEFZEL® copolymer of ethylene and tetrafluoroethylene solution in a spin agent comprised of 100% dichloromethane, 100% 3,3,4,4,5,5,6,6,6-nonafluoro-1-hexene, or one of three mixtures of dichloromethane and 3,3,4,4,5,5,6,6,6-nonafluoro-1-hexene.

FIG. 6 is a plot of the cloud point data for a 20% by weight TEFZEL® copolymer solution of ethylene and tetrafluoroethylene in a spin agent comprised of a mixture of dichloromethane and 3,3,4,4,5,5,6,6,6-nonafluoro-1-hexene at 2 different spin agent weight ratios (25/75, curve 61; and 50/50, curve 62), or 100% 3,3,4,4,5,5,6,6,6-nonafluoro-1-hexene (curve 60), or 100% dichloromethane (curve 63).

Figure 7:
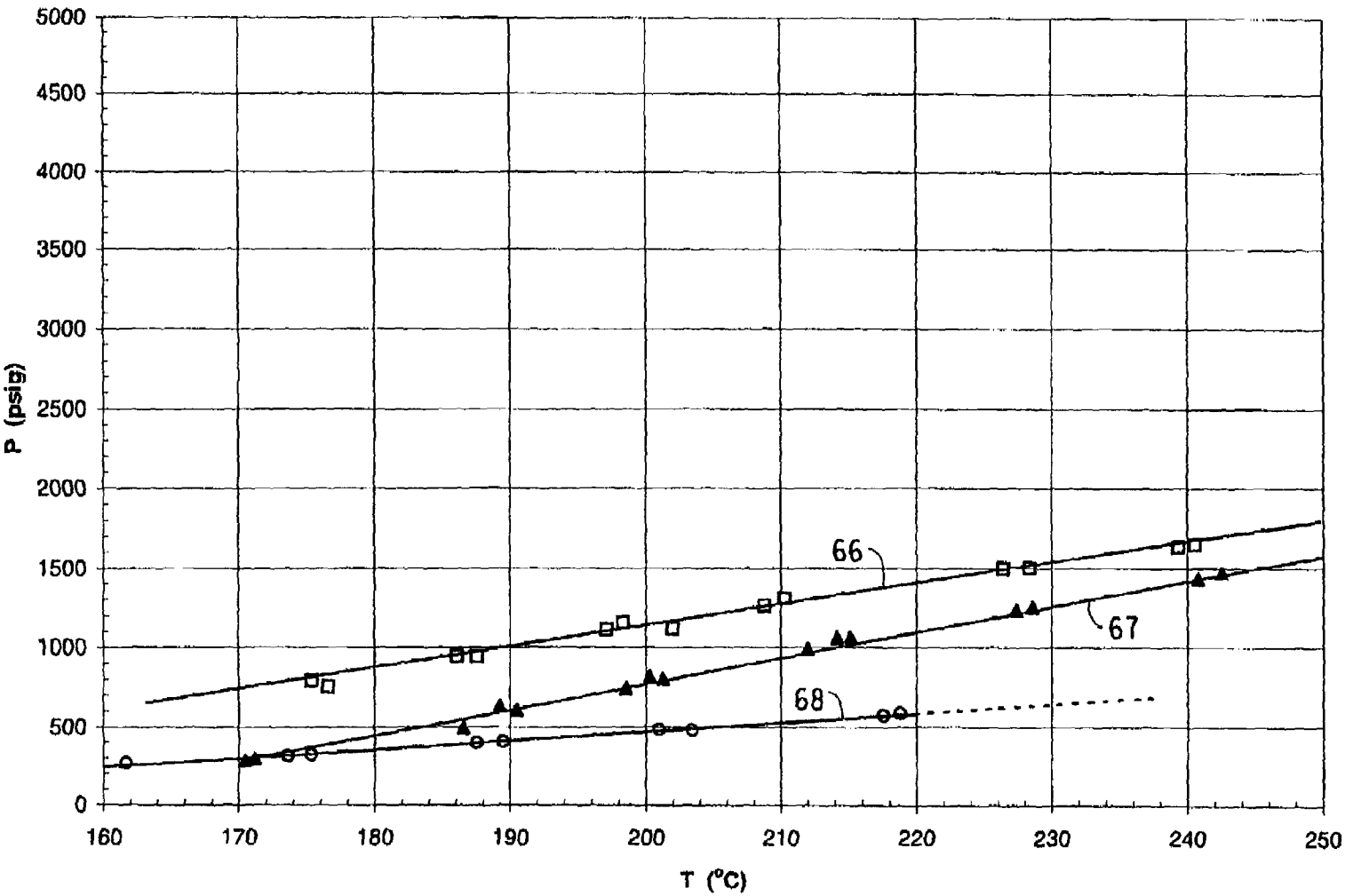
FIG. 7 is a plot of the cloud point data for a 20% by weight TEFZEL® copolymer of ethylene and tetrafluoroethylene solution in a spin agent comprised of 100% trans-1,2-dichloroethylene or one of two mixtures of trans-1,2-dichloroethylene and 3,3,4,4,5,5,6,6,6-nonafluoro-1-hexene.

FIG. 7 is a plot of the cloud point data for a 20% by weight TEFZEL® copolymer solution of ethylene and tetrafluoroethylene in a spin agent comprised of a mixture of trans-1,2-dichloroethylene and 3,3,4,4,5,5,6,6,6-nonafluoro-1-hexene at 2 different spin agent weight ratios (25/75, curve 66; and 50/50, curve 67), or 100% trans-1,2-dichloroethylene (curve 68).

Figure 8:
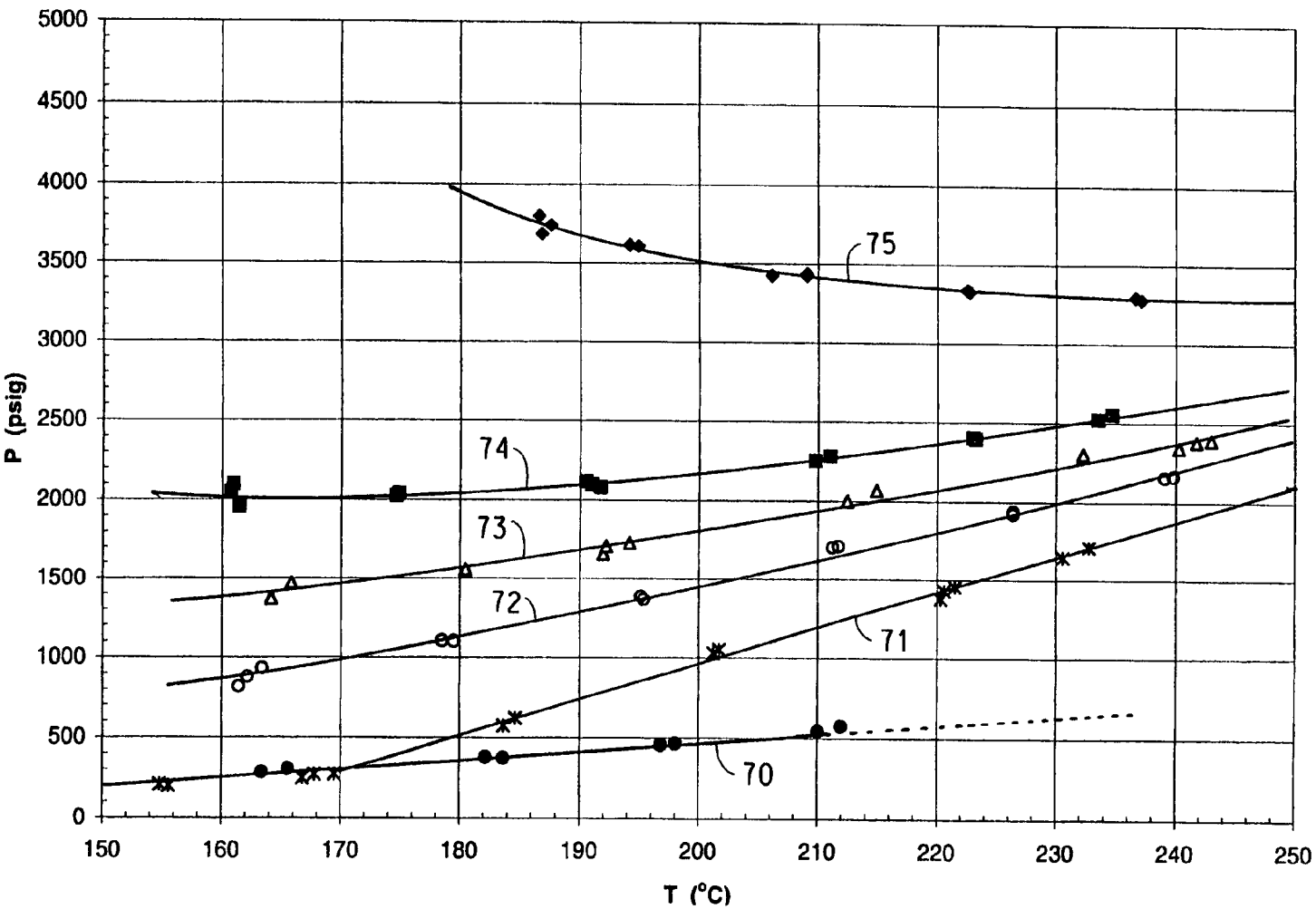
FIG. 8 is a plot of the cloud point data for a 12% by weight high density polyethylene solution in a spin agent comprised of 100% trans-1,2-dichloroethylene or one of five mixtures of trans-1,2-dichloroethylene and 3,3,4,4,5,5,6,6,6-nonafluoro-1-hexene.

FIG. 8 is a plot of the cloud point data for a 12% by weight high density polyethylene solution in a spin agent comprised of a mixture of trans-1,2-dichloroethylene and 3,3,4,4,5,5,6,6,6-nonafluoro-1-hexene at four different spin agent weight ratios (65/35, curve 75; 70/30, curve 74; 72.5/27.5, curve 73; 75/25, curve 72; and 80/20, curve 71), or 100% trans-1,2-dichloroethylene (curve 70).

Figure 9:
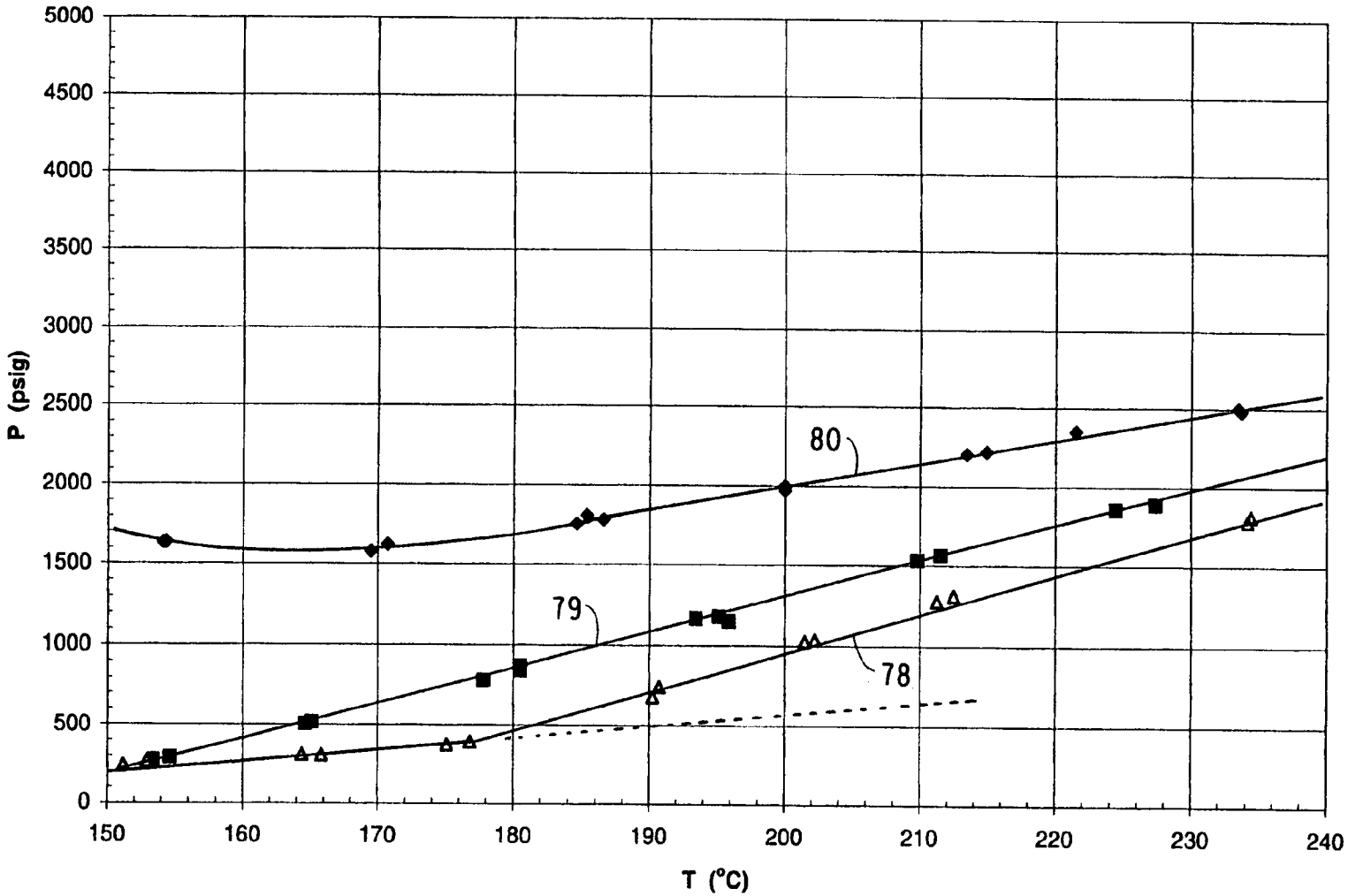
FIG. 9 is a plot of the cloud point data for a 12% by weight polyethylene solution in a spin agent comprised of three mixtures of dichloromethane and 3,3,4,4,5,5,6,6,6-nonafluoro-1-hexene.

FIG. 9 is a plot of the cloud point data for a 12% by weight high density polyethylene solution in a spin agent comprised of a mixture of dichloromethane and 3,3,4,4,5,5,6,6,6-nonafluoro-1-hexene at three different spin agent weight ratios (75/25, curve 80; 80/20, curve 79, and 85/15, curve 78).

This invention will now be illustrated by the following non-limiting examples which are intended to illustrate the invention and not to limit the invention in any manner.

EXAMPLES

The apparatus used in the Examples is the spinning apparatus described in U.S. Pat. No. 5,147,586. The apparatus consists of two high pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32 inch (0.23 cm) diameter channel and a mixing chamber containing a series of fine mesh screens that act as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consists of a lead hole of 0.25 inch (0.63 cm) diameter and about 2.0 inch (5.08 cm) length, and a spinneret orifice with a length and a diameter each measuring 30 mils (0.762 mm). The pistons are driven by high pressure water supplied by a hydraulic system.

In the tests reported in Examples 1–19, the apparatus described above was charged with pellets of a polymer and a spin agent. High pressure water was used to drive the pistons to generate a mixing pressure of between 1500 and 4500 psig (10,239–30,717 kPa). The polymer and spin agent were then heated to the mixing temperature and held at that temperature for a specified period of time during which the pistons were used to alternately establish a differential pressure of about 50 psi (345 kPa) or higher between the two cylinders so as to repeatedly force the polymer and spin agent through the mixing channel from one cylinder to the other to provide mixing and to effect formation of a spin fluid. The spin fluid temperature was then raised to the final spin temperature, and held there for about 15 minutes or longer to equilibrate the temperature, during which time mixing was continued. In order to simulate a pressure letdown chamber, the pressure of the spin fluid was reduced to a desired spinning pressure just prior to spinning. This was accomplished by opening a valve between the spin cell and a much larger tank of high pressure water ("the accumulator") held at the desired spinning pressure. The spinneret orifice is opened as rapidly as possible after the opening of the valve between the spin cell and the accumulator. This generally takes about one to three seconds. This is intended to simulate the letdown chamber effect that is used in larger scale spinning operations. The resultant flash-spun product was collected in a stainless steel open mesh screen basket. The pressure recorded just before the spinneret (using a computer) during spinning is entered as the spin pressure.

It is noted that pressures may be expressed as psig which is pounds per square inch gage which is approximately 15 psi less than psia (pound per square inch absolute). The unit psi is considered the same as psia. For converting to SI units, 1 psi=6.9 kPa. In the following tables pressures are reported in psig with the corresponding kPa values in parentheses.

Examples 1–3

In Examples 1–3, high density polyethylene having a melt index of 0.75 g/10 min (measured according to ASTM D1238 at 190° C. and 2.16 kg load) and a density of 0.95 g/cm$^3$ (Alathon®, obtained from Equistar Chemicals LP of Houston, Tex.) was flash spun using a mixture of trans-1,2-dichloroethylene (DCE) and Zonyl® PFBE (3,3,4,4,5,5,6,6,6-nonafluoro-1-hexene, obtained from DuPont) as the spin agent.

Spin fluids were prepared having concentrations of high density polyethylene of 12 weight percent, 14 weight percent, and 10 weight percent (based on the total weight of the spin fluid) for Examples 1, 2, and 3, respectively. The spin agent was a mixture of 75 wt % trans-1,2-dichloroethylene and 25 wt % PFBE, based on the total weight of spin agent. A diphosphite thermal stabilizer (Weston 619F, from GE Specialty Chemicals) was added at 0.1 weight percent, based on total spin agent. The cloud point pressure plot for the spin solution of Example 1 is shown in FIG. 8 as curve 72.

Plexifilamentary fibers of good quality were obtained by flash spinning the spin fluids using the spinning conditions given in Table 1.

Example 4

In this example, high density polyethylene having a melt index of 0.75 g/10 min (measured according to ASTM D1238 at 190° C. and 2.16 kg load) and a density of 0.95 g/cm$^3$ (Alathon®, obtained from Equistar Chemicals LP of Houston, Tex.) was flash spun using a mixture of dichloromethane and Zonyl® PFBE (3,3,4,4,5,5,6,6,6-nonafluoro-1-hexene, obtained from DuPont) as the spin agent. A spin fluid was prepared having a concentration of high density polyethylene of 12 weight percent based on the total weight of the spin fluid. The spin agent was a mixture of 80 wt % dichloromethane and 20 wt % PFBE, based on the total weight of spin agent. A diphosphite thermal stabilizer (Weston 619F, from GE Specialty Chemicals) was added at 0.1 weight percent, based on total spin agent. The cloud point pressure plot for the spin solution of Example 4 is shown in FIG. 9 as curve 79.

Plexifilamentary fibers of good quality were obtained by flash spinning the spin fluid using the spinning conditions given in Table 1.

TABLE 1

Flash Spinning of High Density Polyethylene Plexifilamentary Fibers

| | | Mixing | | | | Spinning | | | Properties | | | | |
|---|---|---|---|---|---|---|---|---|---|---|---|---|---|
| Ex. No. | Solvent | Temp ° C. | Min | Back P psig | ΔP psig | Accum P psig | Spin P psig | Temp ° C. | gms load | Den | Ten gpd | Mod gpd | E % |
| 1 | 75/25 DCE/PFBE | 190 | 15 | 2000 (13686) | 300 (1965) | 900 (6102) | 750 (5068) | 190 | 100 | 240 | 5.60 | 13.8 | 104 |
| 2 | 75/25 DCE/PFBE | 190 | 20 | 2000 (13686) | 200 (1276) | 1100 (7481) | 850 (5757) | 190 | 100 | 319 | 4.78 | 16.1 | 61 |
| 3 | 75/25 DCE/PFBE | 190 | 20 | 2000 (13686) | 200 (1276) | 1100 (7481) | 975 (6619) | 190 | 100 | 215 | 5.27 | 19.5 | 70 |
| 4 | 80/20 $CH_2Cl_2$/PFBE | 190 | 20 | 2000 (13686) | 200 (1276) | 850 (5757) | 700 (4723) | 191 | 100 | 218 | 5.46 | 21.5 | 60 |

Example 5

In this example, Tefzel® fluoropolymer (grade HT 2129 obtained from DuPont) was flash spun from a mixture of trans-1,2-dichloroethylene (DCE) and Zonyl® PFBE (3,3,4,4,5,5,6,6,6-nonafluoro-1-hexene, obtained from DuPont). Tefzel® HT 2129 fluoropolymer is a copolymer of substantially alternating monomer units of ethylene and tetrafluoroethylene with a melt flow rate of 7 g/10 min (measured according to ASTM D3159) and a melting point of about 240° C.

A spin fluid was prepared having a concentration of 20 wt % Tefzel® fluoropolymer based on the total weight of the spin fluid. The spin agent was a mixture of 25 wt % trans-1,2-dichloroethylene and 75 wt % PFBE, based on the total weight of spin agent. The cloud point pressure plot for the spin solution of Example 5 is shown in FIG. 7 as curve 66.

Example 8a

In Example 8a, Tefzel® fluoropolymer (grade HT 2129 obtained from DuPont) was flash spun from 100% Zonyl® PFBE (3,3,4,4,5,5,6,6,6-nonafluoro-1-hexene, obtained from DuPont). Tefzel® HT 2129 fluoropolymer is a copolymer of substantially alternating monomer units of ethylene and tetrafluoroethylene with a melt flow rate of 7 g/10 min (measured according to ASTM D3159) and a melting point of about 240° C.

The spin fluid was prepared having a concentration of 20 wt % Tefzel® fluoropolymer based on the total weight of the spin fluid. The spin agent was 100% PFBE. The cloud point pressure plot for the spin solution of Example 6 is shown in FIG. 6 as curve 60.

The spinning conditions and product properties are reported in Table 2. Plexifilaments of good quality were obtained.

TABLE 2

Flash Spinning of Tefzel ® Fluoropolymer Plexifilamentary Fibers

| | | Mixing | | | | Spinning | | | Properties | | | | |
|---|---|---|---|---|---|---|---|---|---|---|---|---|---|
| Ex. No. | Solvent | Temp ° C. | min | Back P psig | ΔP psig | Accum P psig | Spin P Psig | Temp ° C. | gms load | Den | Ten gpd | Mod gpd | E % |
| 5 | 25/75 DCE/PFBE | 220 | 30 | 2500 (17133) | 400 (2654) | 1400 (9549) | 1375 (9377) | 219 | 10 | 458 | 1.46 | 7.39 | 24 |
| 6 | 25/75 $CH_2Cl_2$/ PFBE | 220 | 30 | 2500 (17133) | 400 (2654) | 1000 (6791) | 900 (6102) | 220 | 20 | 280 | 1.49 | 8.78 | 23 |
| 7 | 25/75 $CH_2Cl_2$/ PFBE | 210 | 30 | 2500 (17133) | 400 (2654) | 900 (6102) | 800 (5412) | 210 | 40 | 481 | 1.70 | 10.2 | 21 |
| 8 | 25/75 $CH_2Cl_2$/ PFBE | 210 | 30 | 2500 (17133) | 400 (2654) | 1300 (8860) | 1100 (7481) | 212 | 20 | 573 | 1.27 | 8.6 | 19 |
| 8a | 100% PFBE | 220 | 30 | 2500 (17133) | 600 (2654) | 2100 (14376) | 1725 (11790) | 220 | 40 | 632 | 1.3 | 6.15 | 19 |

Plexifilamentary fibers of good quality were obtained by flash spinning the spin fluid using the spinning conditions given in Table 2.

Examples 6–8

In Examples 6–8, Tefzel® fluoropolymer (grade HT 2129 obtained from DuPont) was flash spun from a mixture of dichloromethane and Zonyl® PFBE (3,3,4,4,5,5,6,6,6-nonafluoro-1-hexene, obtained from DuPont). Tefzel® HT 2129 fluoropolymer is a copolymer of substantially alternating monomer units of ethylene and tetrafluoroethylene with a melt flow rate of 7 g/10 min (measured according to ASTM D3159) and a melting point of about 240° C.

Spin fluids were prepared having a concentration of 20 wt % Tefzel® fluoropolymer based on the total weight of the spin fluid. The spin agent used in each of the spin fluids was a mixture of 25 wt % dichloromethane and 75 wt % PFBE, based on the total weight of spin agent. The cloud point pressure plot for the spin solution of Examples 6–8 is shown in FIG. 6 as curve 61.

Different spinning conditions were used for Examples 6–8, as detailed in Table 2. Plexifilaments of good quality were obtained in every case.

Examples 9–12

In Examples 9–12, Kynar® polyvinylidene fluoride polymer (grade 760, obtained from Elf Atochem) was flash spun from a mixture of dichloromethane and Zonyl® PFBE (3,3,4,4,5,5,6,6,6-nonafluoro-1-hexene, obtained from DuPont). Kynar® 760 polyvinylidene fluoride polymer resins has a melting point of 165 –170° C. and a melt flow rate of 24 g/10 min (measured according to ASTM D1238 at 450° F. (232° C.) and 27.6 pounds (12.5 kg) load).

Spin fluids were prepared having a concentration of 12 wt % Kynar® fluoropolymer based on the total weight of the spin fluid for Examples 9–11 and 18 wt % for Example 12. The spin agent used in each of the spin fluids was a mixture of 85 wt % dichloromethane and 15 wt % PFBE, based on the total weight of spin agent. A diphosphite thermal stabilizer (Weston 619F, from GE Specialty Chemicals) was added at 0.1 weight percent, based on total spin agent. The cloud point pressure plot for the spin solution of Examples 9–11 is shown in FIG. 5 as curve 56.

Spinning conditions for Examples 9–12 are given in Table 3. Plexifilaments of good quality were obtained in each spin test.

TABLE 3

Flash Spinning of Kynar ® Fluoropolymer Plexifilamentary Fibers

| | | Mixing | | | | Spinning | | | Properties | | | | |
|---|---|---|---|---|---|---|---|---|---|---|---|---|---|
| Ex. No. | Solvent | Temp ° C. | Min | Back P psig | ΔP psig | Accum P psig | Spin P psig | Temp ° C. | gms load | Den | Ten gpd | Mod gpd | E % |
| 9 | 85/15 $CH_2Cl_2$/ PFBE | 200 | 30 | 2200 (15066) | 200 (1276) | 1050 (7176) | 975 (6619) | 200 | 40 | 242 | 1.34 | 3.73 | 88 |
| 10 | 85/15 $CH_2Cl_2$/ PFBE | 210 | 30 | 2200 (15066) | 200 (1276) | 1300 (8860) | 1200 (8170) | 210 | 40 | 238 | 1.45 | 3.53 | 85 |
| 11 | 85/15 $CH_2Cl_2$/ PFBE | 220 | 30 | 2500 (17133) | 200 (1276) | 1550 (9894) | 1450 (9894) | 220 | 40 | 245 | 1.48 | 3.77 | 83 |
| 12 | 85/15 $CH_2Cl_2$/ PFBE | 210 | 30 | 2200 (15066) | 200 (1276) | 1175 (7308) | 1075 (7708) | 210 | 40 | 357 | 2.21 | 6.45 | 72 |

Examples 13–16

In Examples 13–16, Halar® fluoropolymer resin (grade 901, obtained from Ausimont), comprised of a copolymer of ethylene and chlorotrifluoroethylene, was flash spun from a mixture of trans-1,2-dichloroethylene and Zonyl® PFBE (3,3,4,4,5,5,6,6,6-nonafluoro-1-hexene, obtained from DuPont). Halar® 901 fluoropolymer resin has a melting point of 240° C. and a melt index of about 1 g/10 min.

Spin fluids were prepared having a concentration of 20 wt % Halar® fluoropolymer based on the total weight of the spin fluid. The spin agent used in Examples 13–15 was a mixture of 70 wt % trans-1,2-dichloroethylene (DCE) and 30 wt % PFBE, based on the total weight of spin agent. The spin agent for Example 16 was a mixture of 60 wt % trans-1,2-dichloroethylene and 40 wt % PFBE, based on the total weight of spin agent. A diphosphite thermal stabilizer (Weston 619F, from GE Specialty Chemicals) was added at 0.1 weight percent, based on total spin agent. The cloud point pressure plot for the spin solution of Examples 13–15 is shown in FIG. 4 as curve 52. The cloud point pressure plot for the spin solution of Example 16 is shown in FIG. 4 as curve 51.

Spinning conditions for Examples 13–16 are given in Table 4. Plexifilaments of good quality were obtained in each spin test.

Examples 17–18

In Examples 17–18, polypropylene (obtained from Montell) having a melt flow rate of 1.4 g/10 min (measured according to ASTM D1238 at 190° C. and 2.16 kg load) and a melting point of 165° C. was flash spun from a mixture of trans-1,2-dichloroethylene and Zonyl® PFBE (3,3,4,4,5,5,6,6,6-nonafluoro-1-hexene, obtained from DuPont).

Spin fluids were prepared having a concentration of 10 wt % polypropylene, based on the total weight of the spin fluid. The spin agent used was a mixture of 60 wt % trans-1,2-dichloroethylene (DCE) and 40 wt % PFBE, based on the total weight of spin agent. A diphosphite thermal stabilizer (Weston 619F, from GE Specialty Chemicals) was added at 0.1 weight percent, based on total spin agent. The cloud point pressure plot for the spin solution of Examples 17 and 18 is shown in FIG. 2 as curve 41.

Spinning conditions for Examples 17–18 are given in Table 5. Plexifilaments of good quality were obtained in each spin test.

TABLE 4

Flash Spinning of Halar ® Fluoropolymer Plexifilamentary Fibers

| | | Mixing | | | | Spinning | | | Properties | | | | |
|---|---|---|---|---|---|---|---|---|---|---|---|---|---|
| Ex. No. | Solvent | Temp ° C. | Min | Back P psig | ΔP psig | Accum P psig | Spin P psig | Temp ° C. | gms load | Den | Ten gpd | Mod gpd | E % |
| 13 | 70/30 DCE/PFBE | 210 | 15 | 2000 (13686) | 250 (1620) | 800 (5412) | 700 (4723) | 209 | 40 | 349 | 1.32 | 10.4 | 30 |
| 14 | 70/30 DCE/PFBE | 210 | 15 | 2000 (13686) | 250 (1620) | 900 (6102) | 800 (5412) | 210 | 40 | 382 | 1.78 | 13.4 | 35 |
| 15 | 70/30 DCE/PFBE | 210 | 15 | 2000 (13686) | 250 (1620) | 1000 (6791) | 900 (6102) | 211 | 40 | 379 | 1.93 | 13.7 | 33 |
| 16 | 60/40 DCE/PFBE | 210 | 15 | 2000 (13686) | 250 (1620) | 1275 (8687) | 1150 (7826) | 211 | 40 | 493 | 1.35 | 9.27 | 29 |

TABLE 5

Flash Spinning of Polypropylene Plexifilamentary Fibers

| | | Mixing | | | | Spinning | | | Properties | | | | |
|---|---|---|---|---|---|---|---|---|---|---|---|---|---|
| Ex. No. | Solvent | Temp ° C. | Min | Back P psig | ΔP psig | Accum P psig | Spin P psig | Temp ° C. | gms load | Den | Ten gpd | Mod gpd | E % |
| 17 | 60/40 DCE/PFBE | 210 | 30 | 2500 (15066) | 400 (2654) | 1100 (7481) | 950 (6447) | 209 | 40 | 209 | 1.92 | 4.1 | 122 |
| 18 | 60/40 DCE/PFBE | 210 | 30 | 2500 (15066) | 400 (2654) | 1000 (6791) | 950 (6447) | 209 | 40 | 198 | 2.22 | 5.2 | 94 |

Example 19

In this example, high density polyethylene having a melt index of 0.75 g/10 min (measured according to ASTM D1238 at 190° C. and 2.16 kg load) and a density of 0.95 g/cm$^3$ (Alathon®, obtained from Equistar Chemicals LP of Houston, Tex.) was flash spun using a mixture of cyclopentane and Zonyl® PFBE (3,3,4,4,5,5,6,6,6-nonafluoro-1-hexene, obtained from DuPont) as the spin agent. A spin fluid was prepared having a concentration of high density polyethylene of 18 weight percent based on the total weight of the spin fluid. The spin agent was a mixture of 65 wt % cyclopentane and 35 wt % PFBE, based on the total weight of spin agent. A diphosphite thermal stabilizer (Weston 619F, from GE Specialty Chemicals) was added at 0.1 weight percent, based on total spin agent. The cloud point pressure plot for the spin solution of Example 19 is shown in FIG. 3 as curve 46.

The spin fluid was prepared at a mixing temperature of 200° C., mixing time of 20 minutes, with a back pressure of 2500 psig and ΔP of 250. Flash spinning was conducted with an accumulator pressure of 1300 psig, spin pressure of 1150 psig, and spin temperature of 200° C. Plexifilamentary fibers of good quality were obtained having a denier of 262 (100 g load), tenacity of 2.57 grams per denier, modulus of 6.31 grams per denier, and a percent elongation of 100%.

What is claimed is:

1. A process for the preparation of plexifilamentary film-fibril strands of synthetic fiber-forming polymer which comprises generating a spin fluid consisting essentially of (a) 5 to 30 wt. % of a synthetic fiber-forming polymer, (b) a primary spin agent selected from the group consisting of hydrocarbons with 4 to 7 carbon atoms, and chlorinated, brominated and fluorinated compounds, and (c) a co-spin agent selected from the group consisting of fluorinated organic compounds containing 4 to 8 carbon atoms and a double bond, and having an atmospheric boiling point of less than 100° C., said co-spin agent being present in the spin fluid in an amount sufficient to raise the cloud point pressure of the spin fluid by at least 345 kPa; and flash-spinning the spin fluid at a pressure that is greater than the autogenous pressure of the spin fluid into a region of lower pressure to form plexifilamentary film-fibril strands of said synthetic fiber-forming polymer.

2. The process of claim 1 wherein the co-spin agent is selected from the group consisting of perfluorocarbons, hydrofluorocarbons, hydrochlorofluorocarbons, hydrofluoroethers, hydrofluoroesters, hydrofluoroalcohols, hydrofluoroketones, and mixtures thereof.

3. The process of claim 2 wherein the co-spin agent is 3,3,4,4,5,5,6,6,6-nonafluoro-1-hexene.

4. The process of claim 2 wherein the primary spin agent is selected from the group of dichloroethylene, dichloroethane, dichloromethane, 1,1,2-trichloro-2,2-difluoroethane, bromochloromethane, perfluorodecalin, cyclopentane, n-pentane, cyclohexane, n-hexane, n-heptane, and mixtures thereof.

5. The process of claim 4 wherein the co-spin agent is 3,3,4,4,5,5,6,6,6-nonafluoro-1-hexene.

6. The process of claim 2 wherein the synthetic fiber-forming polymer is selected from the group consisting of polyolefins, partially fluorinated hydrocarbons, and fully fluorinated hydrocarbons.

7. The process of claim 6 wherein the synthetic fiber-forming polymer is a polyolefin.

8. The process of claim 7 wherein the synthetic fiber-forming polymer is polyethylene.

9. The process of claim 8 wherein the spin fluid contains 8 to 18 wt. % polyethylene polymer.

10. The process of claim 3 wherein the co-spin agent comprises 10 to 80 wt. % of total weight of the primary and co-spin agents.

11. The process of claim 2 wherein the co-spin agent has no flash point.

12. The process of claim 2 wherein the co-spin agent has a flash point greater than 0° C.

13. The process of claims 11 or 12 wherein the co-spin agent has an Ozone Depletion Potential of less than 0.1 and a Global Warming Potential of less than 200.

14. The process of claim 13 wherein the co-spin agent has an Ozone Depletion Potential of less than 0.05 and a Global Warming Potential of less than 100.

15. The process of claim 14 wherein the co-spin agent has a Global Warming Potential of less than 10.

16. The process of claim 1 wherein the co-spin agent is present in the spin fluid in an amount sufficient to raise the cloud point pressure of the spin fluid by at least 1379 kPa.

17. The process of claim 2 wherein the co-spin agent has a boiling point greater than 0° C.

18. The process of claim 2 wherein the co-spin agent includes at least one hydrogen atom.

19. A spin fluid consisting essentially of (a) 5 to 30 wt. % of a synthetic fiber-forming polymer, (b) a primary spin agent selected from the group consisting of hydrocarbons with 4 to 7 carbon atoms, and chlorinated, brominated and fluorinated compounds, and (c) a co-spin agent selected from the group consisting of fluorinated organic compounds containing 4 to 8 carbon atoms and a double bond, and having an atmospheric boiling point of less than 100° C., said co-spin agent being present in the spin fluid in an amount sufficient to raise the cloud point pressure of the spin fluid by at least 345 kPa.

20. The spin fluid of claim 19 wherein the co-spin agent is selected from the group consisting of perfluorocarbons, hydrofluorocarbons, hydrochlorofluorocarbons, hydrofluoroethers, hydrofluoroesters, hydrofluoroalcohols, and hydrofluoroketones.

21. The spin fluid of claim 20 wherein the co-spin agent is 3,3,4,4,5,5,6,6,6-nonafluoro-1-hexene.

22. The spin fluid of claim 21 wherein the primary spin agent is dichloroethylene.

23. The spin fluid of claim 20 wherein the synthetic fiber-forming polymer is selected from the group consisting of polyolefins, partially fluorinated hydrocarbons, and fully fluorinated hydrocarbons.

24. The spin fluid of claim 20 wherein the primary spin agent is selected from the group consisting of dichoroethylene, dichloroethane, dichloromethane, 1,1,2-trichloro-2,2-difluoroethane, bromochloromethane, perfluorodecalin, cyclopentane, n-pentane, cyclohexane, n-hexane, n-heptane, and mixtures thereof.

* * * * *